United States Patent [19]

Evert, Jr.

[11] Patent Number: 4,486,017

[45] Date of Patent: Dec. 4, 1984

[54] BOARD WITH MOVABLE GAME PIECES AND ORIENTABLE BARRIER SECTIONS

[76] Inventor: Carl F. Evert, Jr., 3163 Bellewood Ave., Cincinnati, Ohio 45213

[21] Appl. No.: 455,056

[22] Filed: Jan. 3, 1983

[51] Int. Cl.[3] ..... A63F 9/08

[52] U.S. Cl. ..... 273/153 S; 273/281

[58] Field of Search ..... 273/153 R, 153 S, 281

[56] References Cited

U.S. PATENT DOCUMENTS

| | | | |
|---|---|---|---|
| 483,276 | 9/1892 | Anderson | 273/153 S |
| 1,477,371 | 12/1923 | Larabee | 273/153 S |

FOREIGN PATENT DOCUMENTS

| | | | |
|---|---|---|---|
| 752284 | 7/1933 | France | 273/153 S |
| 1946 | of 1900 | United Kingdom | 273/153 R |
| 245004 | 12/1925 | United Kingdom | 273/153 S |

*Primary Examiner*—Anton O. Oechsle

*Attorney, Agent, or Firm*—Wood, Herron & Evans

[57] ABSTRACT

This invention is directed to a board game comprising a board formed with a plurality of spaced holes disposed in columns and rows, inserts adapted to fit within individual holes in the columns and rows to form a playfield having a first series of spaced, parallel channels and a second series of spaced, parallel channels perpendicular to the first channels extending between the inserts, barrier elements disposed at selected positions about the perimeter of the playfield and consecutively-numbered game pieces movable within the first and second channels. The object of the game is to arrange the game pieces in an array along the first and second channels within the playfield so that the numbers on the game pieces in each column, row and diagonal of the array add to the same number.

5 Claims, 4 Drawing Figures

BOARD WITH MOVABLE GAME PIECES AND ORIENTABLE BARRIER SECTIONS

FIELD OF THE INVENTION

This invention relates generally to board games, and more particularly to a board game whose object is to arrange a plurality of numbered game pieces in an array such that the numbers of game pieces in each column, row and diagonal of the array add to the same number.

BACKGROUND OF THE INVENTION

The game of 15 has been known and played for many years. Generally, it involves the placement of nine consecutively numbered game pieces in a 3×3 array of columns and rows such that the numbers on the game pieces in each column, row and diagonal add to 15. Games involving higher order arrays, such as 4×4 arrays in which the numbers on the game pieces in each column, row and diagonal add to the same number, are also known. In addition, games have been devised in which a plurality of numbered game pieces are movable along a game board with the object being to arrange the game pieces in a certain sequence. Such board games typically provide a single empty or open space in which one game piece may be moved out of the way to permit movement of the other pieces into the desired sequence.

While these two types of games have existed for years, it is believed that no attempt has been made to combine them into a single game. Therefore, it is an object of this invention to provide a game board for playing the game of 15.

It is another object of this invention to provide a game board capable of accommodating nine consecutively numbered game pieces for playing the game of 15, which can be expanded to accommodate sixteen or more game pieces for the play of games of greater complexity and difficulty.

It is a further object of this invention to provide a game board for play of the game of 15, which can be altered to provide varying degrees of difficulty and challenge by minor variation in the structure of the board.

SUMMARY OF THE INVENTION

These and other objects are accomplished in this invention of a board game having a base formed with spaced, square holes formed in columns and rows. In a preferred embodiment, a plurality of pegs or inserts are removably disposed within a portion of the holes, in columns and rows, to form a playfield of a given size. The playfield may be expanded in size to include up to all of the holes in the board, if desired, by adding additional inserts. The inserts are arranged in columns and rows within the playfield with spaces therebetween to form a first series of parallel paths or channels perpendicular to a second series of parallel channels in which consecutively-numbered game pieces are movable. As discussed below, the size of the playfield determines the number of game pieces to be used.

Barriers are removably disposed in holes formed in the base which are outside of the playfield defined by the inserts. Each of the barriers may be oriented to receive at least one game piece so that it may be temporarily removed from the playfield to provide room for other game pieces to be moved within the first and second channels formed by the insert means. The game pieces are blocked from movement outside of the playfield by the barriers except for the space in each barrier which can be oriented to receive one game piece at a time. The degree of difficulty of the game is determined at least in part, by the number and orientation of barriers on the perimeter of the playfield. Generally, the more barriers which are oriented to receive a game piece, the easier the game becomes.

The object of the game is to arrange the game pieces along the paths between the inserts in an array of columns and rows such that the summation of the numbers of the game pieces in each column, each row and in the two diagonals of the array is equal. In a preferred embodiment of this invention, nine game pieces consecutively numbered 1–9 are employed and arranged in a 3×3 array of three columns, three rows and two diagonals. In this configuration, the game is completed when the game pieces are arranged in an array such that each column, row and the two diagonals add to 15. Other embodiments of this invention include the use of higher order arrays, such as 4×4 and 5×5 arrays, which increases the challenge and difficulty of the game.

DETAILED DESCRIPTION OF THE DRAWINGS

Figures 1, 2, 3, 4:
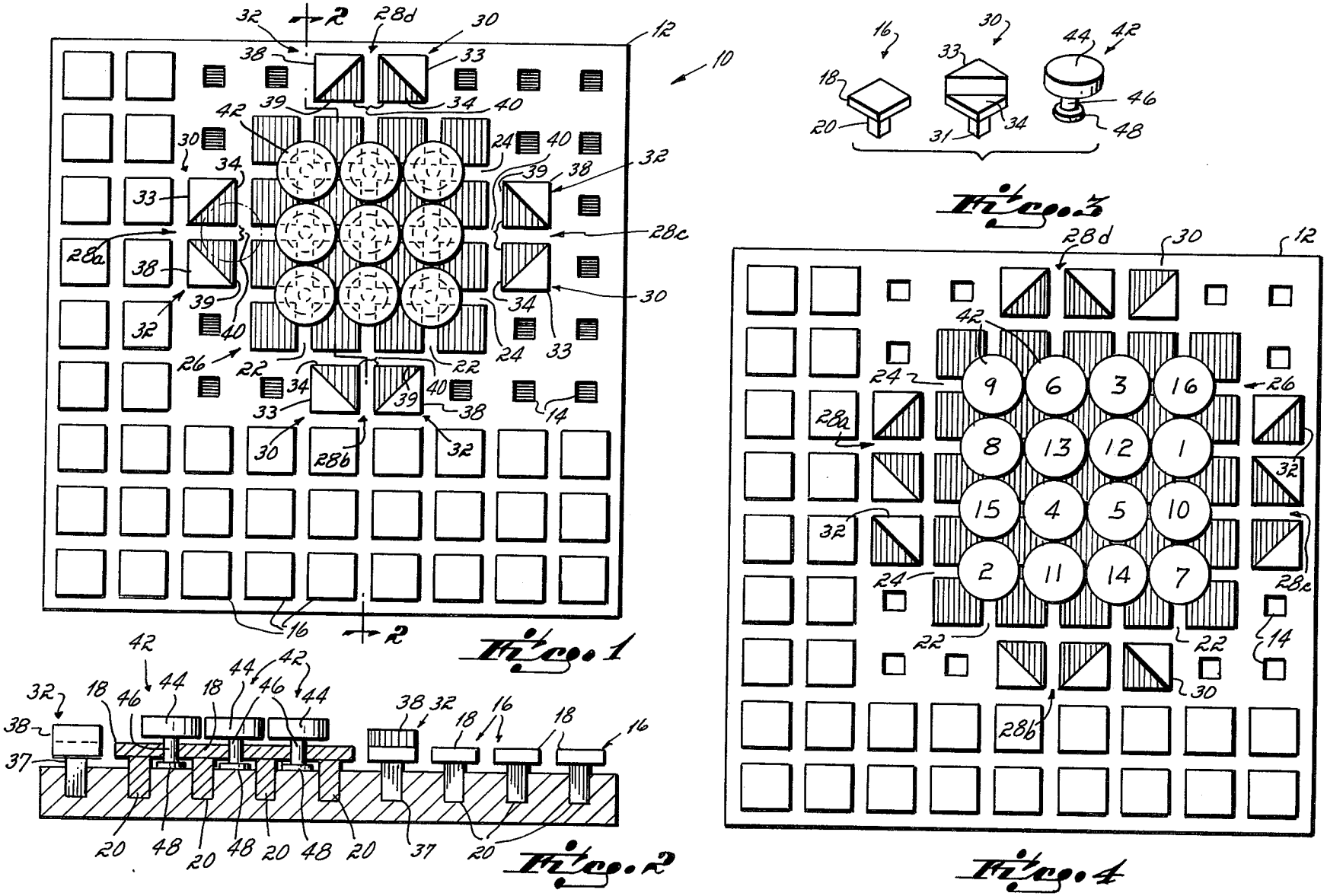
FIG. 1 is an overall isometric view of one embodiment of this invention.
FIG. 2 is a cross-sectional view taken generally along line 2—2 of FIG. 1.
FIG. 3 is an isometric view of a game piece, insert and a section of a barrier element of the invention.
FIG. 4 is a partial isometric view of an alternate embodiment of this invention.

Referring now to the drawings, the board game 10 of this invention includes a base or board 12 made of wood, plastic or similar material, in which a plurality of spaced, square holes 14 are formed in columns and rows. As discussed below, the size of the board 12, and in turn the number of square holes 14 formed therein, may be widely varied in accordance with the teachings of this invention. A plurality of inserts 16 are provided, each being formed in a T-shape with a head section 18 and a stem 20. The stem 20 of each insert 16 is square shaped so as to be insertable within any of the holes 14. Alternately, the holes 14 and stems 20 of inserts 16 may be shaped in virtually any other non-circular configuration, or with two tubular-shaped prongs formed in the stems 20 adapted to fit in pairs of side-by-side holes 14, so that the inserts 16 do not rotate within the holes 14.

As shown in FIG. 1, the holes 14 formed in the board 12 are spaced from one another in columns and rows such that the inserts 16, when placed within the holes 14, are also spaced from one another to form therebetween a first series of spaced, parallel tracks or channels 22 in one direction and a second series of spaced, parallel channels 24 perpendicular to channels 22.

In the embodiment of this invention shown in FIG. 1, sixteen inserts 16 are disposed in a 4×4 array of columns and rows defining a playfield 26. Disposed adjacent the perimeter of playfield 26 are four pairs of barrier elements 28*a–d*. Each of the barrier elements 28*a–d* comprises a right-hand section 30 and left-hand section 31. The right-hand sections 30 are each formed with a stem 31 shaped for insertion into holes 14, and a head section 33. The head section 33 is formed with a triangular-shaped cut-out 34 facing inwardly toward the playfield 26 and disposed in the same horizontal plane as the head sections 18 of inserts 16. The left-hand sections 32 each include a stem 37 shaped for insertion into holes 14 and a head section 38. The head section 38 includes a triangular-shaped cut-out 39 facing inwardly toward the playfield 26 in the same horizontal plane as the cut-out 34 of the right-hand sections 30 and the head sections 18 of inserts 16. The right and left-hand sections 30,32 form mirror images of one another when placed side by side so that the triangular shaped cut-outs 34, 39 face one another, the cut-outs 34, 39 together forming a space 40 which is exterior to the playfield 26.

Referring to the preferred embodiment of this invention shown in FIG. 1, nine game pieces 42 are provided which are consecutively numbered from one to nine. Each of the game pieces 42 is formed with a numbered top section 44 connected to a stem 46 having an outwardly-extending flange 48 at its lower end. The game pieces 42 are moveable within the channels 22, 24 of the playfield 26 formed between the inserts 16, with the flange 48 of the game pieces 42 extending across the width of the channels 22, 24 and beneath the head sections 18 of adjacent inserts 16. The flange 48 of the game pieces 42 prevents them from being removed from the playfield 26 during play so that the game pieces 42 can be advanced only by movement along the channels 22, 24.

The object of the game is to arrange the game pieces 42 in a 3×3 array of columns and rows along the channels 22, 24 of playfield 26, such that the numbers of the game pieces 42 in each of the three rows, three columns and two diagonals of the array add to 15. FIG. 1 illustrates one array of game pieces 42 where each column, row and diagonal totals 15. Other arrays are possible. It is contemplated that play of the board game 10 may stress speed, efficiency of movement or both. Assuming the game pieces 42 are randomly oriented on playfield 26, the player may concentrate on achieving one of the correct orientations of the game pieces in the least number of moves, or, alternately, in the least amount of time. Different correct solutions or arrays of the game pieces 42 may be achieved using less moves than other solutions for a given random orientation of the game pieces 42. Although intended for a single player in the embodiment shown in the drawings, competition among players of the board game 10 may be had by comparing the number of moves required to properly orient the game pieces 42 and/or the time required to do this by each player.

The degree of difficulty of the game may be easily altered by changing the position and orientation of the barrier elements 28*a–d*. As shown in FIG. 1, the right and left hand sections 30, 32 of each barrier element 28*a–d* face one another so that four spaces 40 are provided about the perimeter of the playfield 26. This enables up to four game pieces 42 to escape from playfield 26 at one time, allowing the remaining five game pieces 42 to be readily moved within the playfield 26. It can be appreciated that the degree of difficulty of the game is increased by limiting the number of locations at which game pieces 42 can escape from the playfield 26, since movement of the remaining game pieces 42 becomes more difficult when more of them are in the playfield 26. Elimination of spaces 40 can be achieved by simply disposing one or both of the right and left hand sections 30, 32 of up to three barrier elements 28*a–d* so that their cut-outs 34, 39 do not face inwardly toward the playfield 26. Of course, at least one barrier element 28*a–d* must be oriented to provide a space 40 so that the game pieces 42 can be advanced along the playfield 26. However, this is essentially the only restriction and players are free to decide the location and orientation of the barrier elements 28*a–d* along the perimeter of the playfield 26 as desired. In the event the barrier elements 28*a–d* are not positioned in the centers of sides of the playfield perimeter, as shown in FIG. 1, additional right and/or left hand sections 30, 32 may be used to block one or more of the channels 22, 24 to prevent escape of the game pieces 42 from the playfield 26.

It should be understood that the 3×3 array of nine consecutively-numbered game pieces 42 as shown in FIG. 1 is but one application of this invention. Another advantage of this invention is that the size of the playfield 26 may be expanded by adding additional inserts 16 and barrier elements 28 to the same board 12. For example, a 4×4 array of game pieces 42 consecutively numbered from 1 to 16 may be utilized, wherein the object is to orient the game pieces 42 in a 4×4 array so that all columns, rows and the two diagonals add to the number 34 as shown in FIG. 3. In this embodiment, a 5×5 array of inserts 16 is needed to form playfield 26 as well as additional right and left hand sections 30, 32 to prevent the escape of game pieces 42 from the playfield 26. It is contemplated that the existing barrier elements 28*a–d* may be arranged at any location along their respective sides of the playfield perimeter and oriented to provide one or more spaces 40 for the escape of game pieces 42, at the player's option. Additional right and/or left hand sections 30, 32 may then be added and oriented along the perimeter such that their cut-outs 34, 39 do not face inwardly toward the playfield 26 for blocking the escape of game pieces 42. Other numbers of arrays of inserts 16 and game pieces 42 may be utilized in accordance with the teachings of this invention with the degree of difficulty of the game increasing with the addition of game pieces 42 and reduction of the number of escape spaces 40.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A game comprising:

a board formed with a plurality of spaced holes disposed in columns and rows;

a plurality of insert elements having a head section connected to a stem section, said stem sections being inserted into at least a portion of said holes in columns and rows to define a playfield, said insert elements being spaced relative to one another within said columns and rows to form therebetween a first series of spaced, parallel channels and a second series of spaced, parallel channels perpendicular to said first channels;

a plurality of consecutively numbered game pieces each having a head section, a stem section connected to said head section at one end and a flange connected to the other end of said stem section, said game pieces being movable along said first and second series of channels formed between said insert means; and a plurality of barrier elements disposed exteriorly of and adjacent to said playfield, each of said barrier elements comprising a right hand section and left hand section, said right and left hand sections each being formed with a stem portion adapted for insertion into said holes and a head portion formed with a cut-out, said right and left hand sections of each said barrier elements being adapted to be oriented relative to one another and to said playfield so that said cut-outs thereof form a space for receiving one of said game pieces, said other game pieces being confined within said playfield by said barrier elements collectively, whereby said game pieces may be arranged along said first and second series of channels between said insert means in an array of columns, rows and diagonals such that the summation of the numbers of the game pieces in each column, row and diagonal of said array is equal.

2. A game comprising:

a board formed with columns and rows defining a playfield;

a plurality of numbered game pieces movable along said columns and rows;

a plurality of discrete barrier elements disposed exteriorly of said playfield, each of said barrier elements being formed with receiving means adapted to be oriented to face toward said playfield for receiving said game pieces and to face away from said playfield to block said game pieces from leaving said playfield, at least one of said barrier elements being positioned so that said receiving means thereof is oriented to receive a game piece exteriorly of said playfield, said remaining barrier elements being positioned so that said receiving means thereof block movement of said game pieces from said playfield, whereby said game pieces may be arranged in an array along said columns and rows of said board such that the summation of the numbers of the game pieces in each column, row and diagonal of said array is equal.

3. The game of claim 2 in which each of said barrier elements comprises a right hand section and a left hand section, each said right and left hand sections being formed with a stem portion adapted to mount to said board connected to a head portion formed with a cut-out, said cut-outs of said right and left hand sections together forming said receiving means.

4. The game of claim 2 having 3 columns and 3 rows defining said playfield and 9 consecutively numbered game pieces, said game pieces being movable along said columns and rows to form an array wherein the summation of the game pieces in each column, row and diagonal of the array is 15.

5. The game of claim 2 having 4 columns and 4 rows defining said playfield and 16 consecutively numbered game pieces, said game pieces being movable along said columns and rows to form an array wherein the summation of the game pieces in each column, row and diagonal of the array is 34.

* * * * *